US008888958B2

(12) United States Patent
Bechard et al.

(10) Patent No.: US 8,888,958 B2
(45) Date of Patent: Nov. 18, 2014

(54) PRESSURE DIFFUSER WITH AN ANNULAR BAFFLE SCREEN PLATE OVER WATER INLET

(71) Applicant: Andritz Inc., Glens Falls, NY (US)

(72) Inventors: Grant Bechard, Queensbury, NY (US); Keith Vogel, Queensbury, NY (US); Jay Sheerer, Queensbury, NY (US); Edward James Cummings, Fort Edward, NY (US); Carl Luhrmann, Glens Falls, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 14/097,766

(22) Filed: Dec. 5, 2013

(65) Prior Publication Data

US 2014/0182802 A1 Jul. 3, 2014

Related U.S. Application Data

(60) Provisional application No. 61/747,540, filed on Dec. 31, 2012.

(51) Int. Cl.
*D21C 9/04* (2006.01)

(52) U.S. Cl.
CPC ..... *D21C 9/04* (2013.01)
USPC ..... 162/232; 162/251; 210/323.2; 210/331; 210/499; 8/156; 68/181 R; 68/184

(58) Field of Classification Search
CPC ..... D21C 9/00; D21C 9/04; D21C 7/00; D21D 1/40; D21D 5/02
USPC ..... 162/19, 60, 232, 251, 380; 280/323.2, 280/324, 330–331, 499; 68/18 F, 181 R, 68/182, 184, 190; 8/156; 210/323.2, 324, 210/330–331, 499
See application file for complete search history.

(56) References Cited

U.S. PATENT DOCUMENTS 4,705,600 A * 11/1987 Jacobsen ..... 162/19
4,840,047 A * 6/1989 Richter et al. ..... 68/181 R (Continued)

FOREIGN PATENT DOCUMENTS

CA 2081387 A * 4/1994
EP 545888 A1 * 6/1993

(Continued)

OTHER PUBLICATIONS

Kamyr Inc., "Diffuser Update 7th Edition", Apr. 1994, pp. I-4 to I-5, Kamyr, Inc., Glens Falls, NY, United States.

*Primary Examiner* — Jose Fortuna
(74) *Attorney, Agent, or Firm* — Kerri Hochgesang; Robert Joseph Hornung

(57) ABSTRACT

A pressure diffuser washer comprising: an outer wall, an inner wall adjacent to the outer wall, the inner wall defining annular baffle chambers between the outer wall and the inner wall, wherein each of the annular baffle chambers is configured to connect to a source of a wash liquid, a reciprocating screen assembly adjacent to the inner wall, the reciprocating screen assembly defining a first annular chamber between the inner wall and the reciprocating screen assembly, an area in the inner wall defining a gap associated with each of the annular baffle chambers, wherein the wash liquid from an annular baffle chamber flows through the gap into the first annular chamber, and an annular baffle screen plate covering the gap, wherein the annular baffle screen plate defines openings sized to prevent rocks and other large particulate debris from entering the annular baffle chambers.

13 Claims, 3 Drawing Sheets

(56) References Cited

U.S. PATENT DOCUMENTS

| | | | | | |
|---|---|---|---|---|---|
| 4,971,658 | A | * | 11/1990 | Henricson et al. | 162/21 |
| 5,129,119 | A | * | 7/1992 | Sherman | 8/156 |
| 5,437,170 | A | * | 8/1995 | Nilsson et al. | 68/181 R |
| 5,444,884 | A | * | 8/1995 | Marois | 8/156 |
| 5,567,262 | A | * | 10/1996 | Phillips et al. | 162/251 |
| 5,567,279 | A | * | 10/1996 | Phillips et al. | 162/232 |
| 6,233,983 | B1 | * | 5/2001 | Karlsson | 68/181 R |
| 7,799,173 | B2 | * | 9/2010 | Sheerer et al. | 162/246 |
| 8,157,956 | B2 | * | 4/2012 | Weston et al. | 162/60 |
| 8,747,613 | B2 | * | 6/2014 | Theiler et al. | 162/60 |
| 2003/0217822 | A1 | * | 11/2003 | Weston et al. | 162/14 |
| 2008/0173415 | A1 | * | 7/2008 | Sheerer et al. | 162/9 |
| 2010/0155003 | A1 | * | 6/2010 | Weston et al. | 162/60 |
| 2012/0216977 | A1 | * | 8/2012 | Theiler et al. | 162/232 |
| 2014/0182802 | A1 | * | 7/2014 | Bechard et al. | 162/232 |

FOREIGN PATENT DOCUMENTS

| | | | | |
|---|---|---|---|---|
| EP | 343393 | B1 | * | 9/1993 |
| EP | 356415 | B1 | * | 1/1995 |
| EP | 545888 | B1 | * | 3/1998 |
| EP | 2295631 | A1 | * | 3/2011 |
| EP | 2295631 | B1 | * | 10/2012 |
| JP | 2011038235 | A | * | 2/2011 |
| WO | WO 2010117312 | A1 | * | 10/2010 |

* cited by examiner

PRESSURE DIFFUSER WITH AN ANNULAR BAFFLE SCREEN PLATE OVER WATER INLET

RELATED APPLICATION

This application claims priority to and incorporates by reference U.S. Provisional Application Ser. No. 61/747,540, filed Dec. 31, 2012.

TECHNICAL FIELD

This disclosure relates generally to pressure diffuser washers for washing pulp material and particularly relates to the water inlets in a pressure diffuser washer.

BACKGROUND OF THE INVENTION

The term "pulp" generally refers to comminuted cellulosic material, such as wood chips, that have been processed in a digester vessel to separate the fibers in the wood chips. Chemicals, e.g., liquor, such as alkaline chemicals, are usually injected into the digester vessel to process and cook the cellulosic material to produce the pulp material. Residual chemicals tend to remain with the pulp material as the pulp material is discharged from the digester vessel.

After digestion, pulp material usually flows from the digester vessel to a pressurized diffuser vessel that washes the pulp material to remove the residual chemicals. A pressurized diffuser washer is typically a large vessel, e.g., 50 feet in height and generally houses a reciprocating screen assembly for washing pulp. Pulp with the residual chemicals can enter an annular chamber inside the pressure diffuser vessel and can fill the annular chamber extending much of the height of the pressure diffuser vessel. Wash water is typically injected into the annular chamber within the pressure diffuser vessel and flows through the pulp material to remove, e.g. displace, the residual chemicals from the pulp material. After the wash water flows through the pulp material the wash water is generally known as "wash filtrate" because it now contains the residual chemicals removed from the pulp material. The wash filtrate generally passes from the annular space of the pressure diffuser vessel to an internal screen assembly within the pressure diffuser vessel. The wash filtrate is typically discharged from a bottom outlet in the pressure diffuser vessel. The washed pulp material is typically discharged from the top of the pressure diffuser washer.

The screen assembly usually moves within the pressure diffuser vessel. Traditionally, the screen assembly moves reciprocally up and down during operation of the pressure diffuser washer. The movement of the screen assembly promotes the flow of pulp material through the annulus in the pressure diffuser vessel. Particularly, the upward movement allows the wash filtrate to enter the pulp material displacing dirty filtrate into the screen assembly and into the bottom of the vessel, where dirty filtrate may be removed. The downward movement of the screen assembly may assist in clearing the perforations or screen holes of fibers and particles that may be blocking the perforations.

The pulp material entering the pressure diffuser washer typically includes rocks and other debris. The debris generally moves with the pulp material as the pulp material moves up through the annular chamber in the pressure diffuser vessel. The debris can enter the water inlets on the outer wall of the annular chamber in the pressure diffuser vessel. The wash water inlets are typically gaps extending in a ring around the outer wall of the pressure diffuser vessel. If the gaps become clogged with rocks or other debris, the efficiency of the pulp wash process in the pressure diffuser vessel generally suffers. Removal of the rocks and debris from the wash water inlet gaps generally requires shutting down the pressure diffuser washer to stop wash water flow and allow the debris to be removed. Shutting down a pressure diffuser washer is expensive and interrupts the production of pulp. There is a long felt desire for a pressure diffuser washer that is less prone to loss of efficiencies and operating disruptions due to debris in the pulp material fed to the pressure diffuser vessel for washing.

SUMMARY

The problem of debris accumulation in the annular baffle chamber of a pressure diffuser vessel has been solved by fixing an annular baffle screen plate with openings into a gap in the inner wall of the first annular chamber. In exemplary embodiments of this disclosure, wash water or other wash liquid, which may generally be referred to as "wash liquid" may enter the annular baffle chamber of a pressure diffuser vessel through an inlet and communicate with pulp in a first annular chamber through an annular baffle screen plate partially separating the first annular chamber from the annular baffle chamber. Pressure from the wash liquid may prevent debris and other contaminants from flowing backward into the annular baffle chamber. Debris and other chemicals may accumulate and be recovered elsewhere in the manufacturing process, for example, in the pulp storage tank.

A pressure diffuser washer has been conceived comprising: A pressure diffuser washer comprising: an outer wall, an inner wall adjacent to the outer wall, the inner wall defining annular baffle chambers between the outer wall and the inner wall, wherein each of the annular baffle chambers is configured to connect to a source of a wash liquid, a reciprocating screen assembly adjacent to the inner wall, the reciprocating screen assembly defining a first annular chamber between the inner wall and the reciprocating screen assembly, an area in the inner wall defining a gap associated with each of the annular baffle chambers, wherein the wash liquid from an annular baffle chamber flows through the gap into the first annular chamber, and an annular baffle screen plate covering the gap, wherein the annular baffle screen plate defines openings sized to prevent rocks and other large particulate debris from entering the annular baffle chambers. The screen assembly may move reciprocally within the inner wall of the pressure diffuser vessel. The pressure diffuser vessel may have a height of at least 50 feet (15 meters).

The gap may extend around the perimeter of the annular baffle chamber and inner wall, and the annular baffle screen plate may extend around the perimeter of the gap.

The annular baffle screen plate may have openings defined by a screen mesh. In another example embodiment, the annular baffle screen plate may have openings defined by and an arrangement of parallel bars. In yet another example embodiment, a screen mesh and arrangement of parallel bars may define the openings of the annular baffle screen plate. The annular baffle screen plate may be cylindrical, wherein the inner wall is a cylindrical wall. In some example embodiments, the annular baffle screen plate may have upper and lower edges fixed to the inner wall of the pressure diffuser vessel.

In another exemplary embodiment, a pressure diffuser vessel has been conceived comprising: a vertically extending outer cylindrical wall defining an outer portion of a pressurized vessel, a vertically extending inner cylindrical wall coaxial to the vertically extending outer cylindrical wall, the vertically extending inner cylindrical wall defining annular baffle chambers between the vertically extending outer cylindrical wall and the vertically extending inner cylindrical wall, wherein each of the annular baffle chambers is configured to connect to a source of a wash liquid, an area in the vertically extending inner cylindrical wall defining a gap associated with each of the annular baffle chambers, wherein the wash liquid from an annular baffle chamber flows through the gap into a first annular chamber, and an annular baffle screen plate covering the gap into the first annular chamber, wherein the annular baffle screen plate defines openings sized to prevent rocks and other large particulate debris from entering the annular baffle chamber. The gap may extend around the perimeter of the annular baffle chamber and inner wall, and the annular baffle screen plate extends the perimeter of the gap. The screen assembly may moves reciprocally within the pressure diffuser vessel. The pressure diffuser washer may have a height of at least 50 feet (15 meters).

In an example embodiment, the openings of the annular screen plate may be defined by a screen mesh. In another example embodiment, the openings of the annular screen plate may be defined by an arrangement of parallel bars. The annular baffle screen plate may have upper and lower edges fixed to the inner wall of the pressure diffuser vessel. The orientation of the openings in the annular baffle screen plate may be horizontal, such as about 0 degrees to the horizontal axis of the pressure diffuser vessel, vertical, such as about 90 degrees to the horizontal axis of the pressure diffuser vessel, or any angle in between, such as between 0 degrees to 90 degrees, or 30 degrees to 60 degrees. The upper edge and the lower edge of the annular baffle screen plate openings may be curved, rounded, or chamfered. Additionally, the openings may be tapered, having the narrowest opening where the wash liquid enters the opening.

SUMMARY OF DRAWINGS

The foregoing will be apparent from the following more particular description of example embodiments of the disclosure, as illustrated in the accompanying drawings in which like reference characters refer to the same parts throughout the different views. The drawings are not necessarily to scale, with emphasis instead being placed upon illustrating embodiments of the disclosed device.

DETAILED DESCRIPTION OF INVENTION

Figure 1:
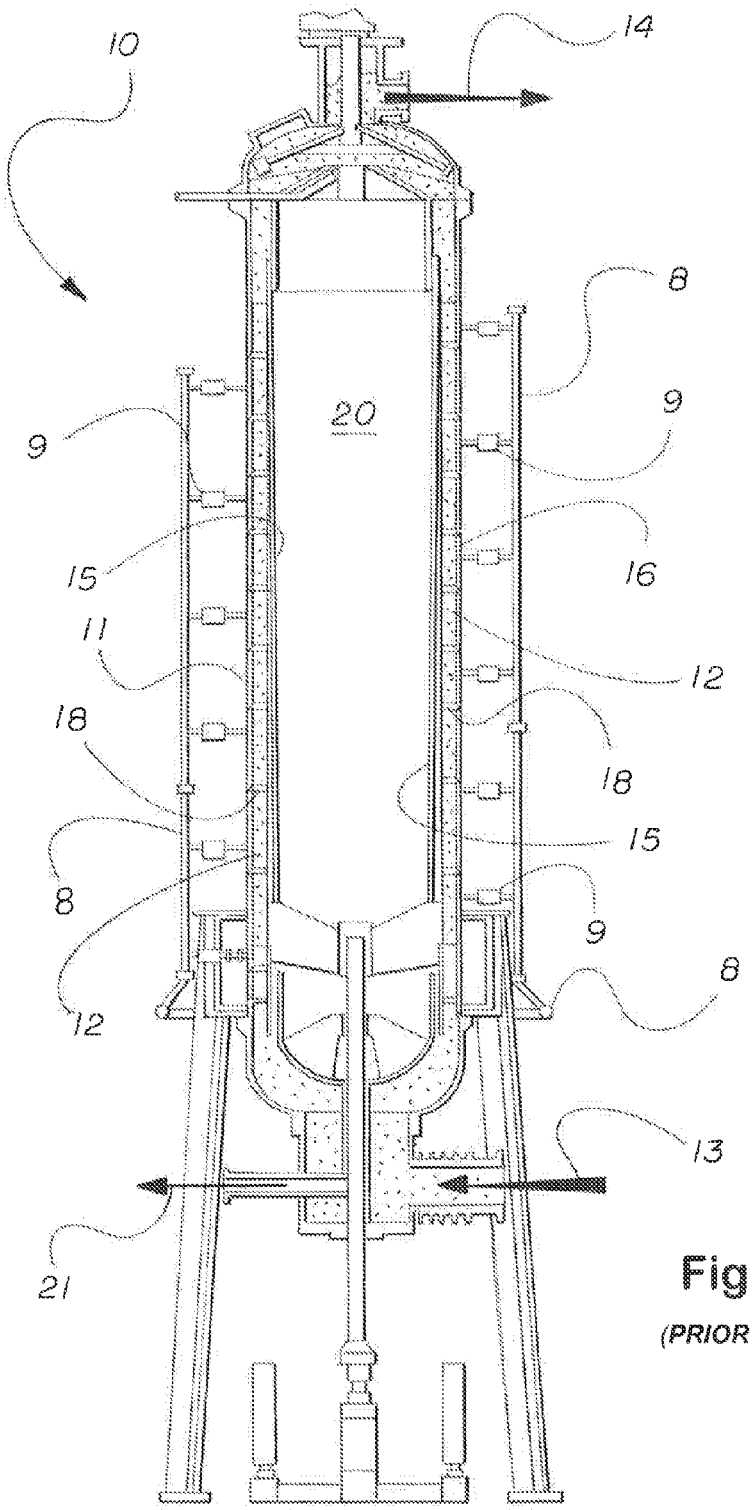
Fig.1 (PRIOR ART)
FIG. 1 is a schematic cross-sectional view of an exemplary conventional pressure diffuser washer.

The foregoing will be apparent from the following more particular description of example embodiments of the disclosure, as illustrated in the accompanying drawings in which like reference characters refer to the same parts throughout the different views. The drawings are not necessarily to scale, with emphasis instead being placed upon illustrating embodiments of the disclosed device.

FIG. 1 shows a conventional pressure diffuser washer 10 comprising a generally vertical, liquid tight, pressurized vessel 11. Within the pressurized vessel 11 is a first annular chamber 12 in which comminuted cellulosic may be treated under pressure. Comminuted cellulosic fibrous material may be cellulosic pulp material. Comminuted cellulosic fibrous material may also be pulp material produced in a digester vessel. The pulp inlet 13 is typically at the bottom of the pressure diffuser washer 10 and the pulp outlet 14 is typically at the top of the pressure diffuser washer 10. An internal screen assembly 15 includes a cylindrical screen extending the vertical length of the pressurized vessel 11. The internal screen assembly 15 may be a cylindrical screen that defines an interior barrier of the first annular chamber 12. Exemplary pressure diffuser washers are shown in the U.S. Pat. Nos. 8,157,956 and 5,567,279 and U.S. Patent Application Publication 2003/0217822, which are all incorporated by reference in their entirety.

Fresh wash liquid may continually flow via wash liquid pipe 8 into the pulp material as the pulp material moves up through the pressure diffuser washer 10. Wash liquid can be injected into the first annular chamber 12 through injectors 9 positioned at various elevations on the outside of the wall of the pressurized vessel 11. For example, the injectors 9 may be at different elevations such that the injectors 9 are evenly spaced in a vertical direction along the height of the pressurized vessel 11. The injectors 9 may be divided into groups, wherein the injectors 9 in each group may be vertically aligned. The groups may be symmetrically arranged around the pressurized vessel 11.

The injectors 9 are typically coupled to wash liquid conduits to direct wash liquid into the pressurized vessel 11. The injectors 9 may be valves through which wash liquid flows from the conduits into the pressurized vessel 11. The injectors 9 may be arranged at elevations along the height of the pressurized vessel 11. The injectors 9 can provide wash liquid that enters the pressurized vessel 11 along the height of the pressurized vessel 11. From each of the injectors 9, the wash liquid enters an annular baffle chamber 16 extending around the first annular chamber 12. Each annular baffle chamber 16 distributes the wash liquid around the perimeter of the first annular chamber 12 such that the wash liquid enters the first annular chamber 12 through conduits 18 flanking the first annular chamber 12.

The wash liquid flows through the conduits 18 into the pulp material in the first annular chamber 12. Wash filtrate may be extracted through perforations in a cylindrical screen of the internal screen assembly 15 and collected in a large center chamber 20 coaxial with the cylindrical screen and first annular chamber 12. The wash filtrate can be discharged from the large center chamber 20 through a wash filtrate output 21 in the bottom of the pressure diffuser vessel 10.

Figure 2:
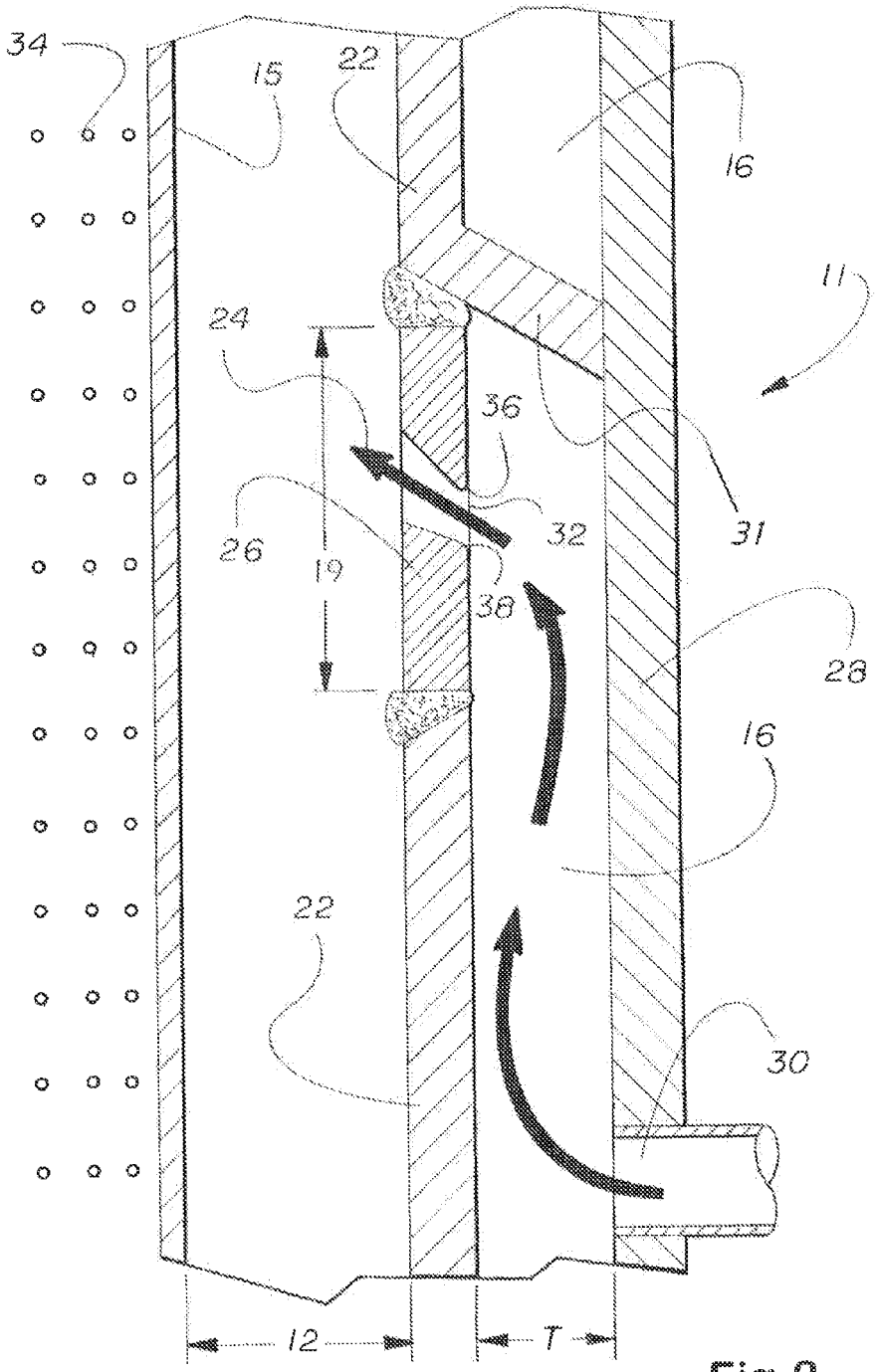
FIG. 2 is a schematic cross-sectional view of a portion of the exemplary annular baffle screen plate disposed within a pressure diffuser washer.

FIG. 2 is a cross-sectional view of portion of the pressure diffuser washer 10 which illustrates the flow of wash liquid into the first annular chamber 12. The width of the first annular chamber 12 may be about six inches (330 mm) between the inner cylindrical wall 22 and the internal screen assembly 15. The wash liquid 24 enters the first annular chamber 12 through gaps 19. These gaps may be defined by areas in the inner cylindrical wall 22 of the pressurized vessel 11. The pulp material moves up through the first annular chamber 12 as it is being washed by the wash liquid 24 that flows generally transverse through the pulp material and across the first annular chamber 12. The wash liquid 24 with residual chemicals from the pulp material passes through small perforations 34 in the wall of the internal screen assembly 15.

The gaps 19 are generally open and typically about 2 inches (50 mm) in height. In an example embodiment of this disclosure, each gap 19 may have an annular baffle screen plate 26 with slots, holes or other openings 32, which may collectively be referred to as "openings" to allow wash liquid 24 to flow into the first annular chamber 12. The annular baffle screen plate 26 may be a generally cylindrical plate having upper and lower edges fixed to the inner wall of the pressure diffuser vessel 10. The openings 32 in the annular screen plate 26 are sized to prevent rocks and other large particulate debris from entering the annular baffle chamber 16 associated with the annular screen plate 26. The openings 32 may each have an upper inlet edge formed by an upper corner 36 and a lower inlet edge formed by a lower corner 38. The upper corner 36 and the lower corner 38 may each be any of curved, rounded, chamfered or any combination thereof.

The openings 32 in the annular screen plate 26 may have a collective cross-sectional area sufficient to allow the wash liquid 24 to flow into the first annular chamber 12 preferably without causing an excessive back pressure on the wash liquid 24 in the annular baffle chamber 16. The width of each opening 32 may be on the order of one-half of an inch or several millimeters, such as 5 mm to 20 mm. By forming the opening 32 as a narrow slot, the length of the opening 32 may be substantially greater than its width. For example, the length of a diagonal slot may be 2 or 3 inches (50 mm to 75 mm). It is not necessary for the openings 32 to be sufficiently narrow to prevent the passage of fibers from the pulp material being washed in the pressure diffuser washer 10. The pressure and flushing action of the wash liquid 24 flowing through the openings 32 prevents fibers and pulp material itself from entering the annular baffle chamber 16.

The annular baffle chamber 16 may be an annular passage formed between an inner cylindrical wall 22 and an outside cylindrical wall 28 of the pressurized vessel 11. A baffle 31 may separate annular baffle chambers 16 arranged vertically. In some embodiments, the annular baffle chambers 16 arranged vertically may be separate by empty spaces. The inner cylindrical wall 22 may correspond to an outside wall of the first annular chamber 12. The annular baffle chamber 16 can distribute wash liquid 24 around the first annular chamber 12. The annular baffle chamber 16 may be relatively narrow, such as a thickness of less than one inch and contain one or more baffles 31. The annular baffle chamber 16 may correspond to the one or more injectors 9 (shown in FIG. 1) at a particular elevation outside of the pressurized vessel 11. The annular baffle chamber 16 has an inlet 30 to receive the wash liquid 24. Each annular baffle chamber 16 may extend a height about the same as or less than the vertical distance between injectors 9.

Figure 3:
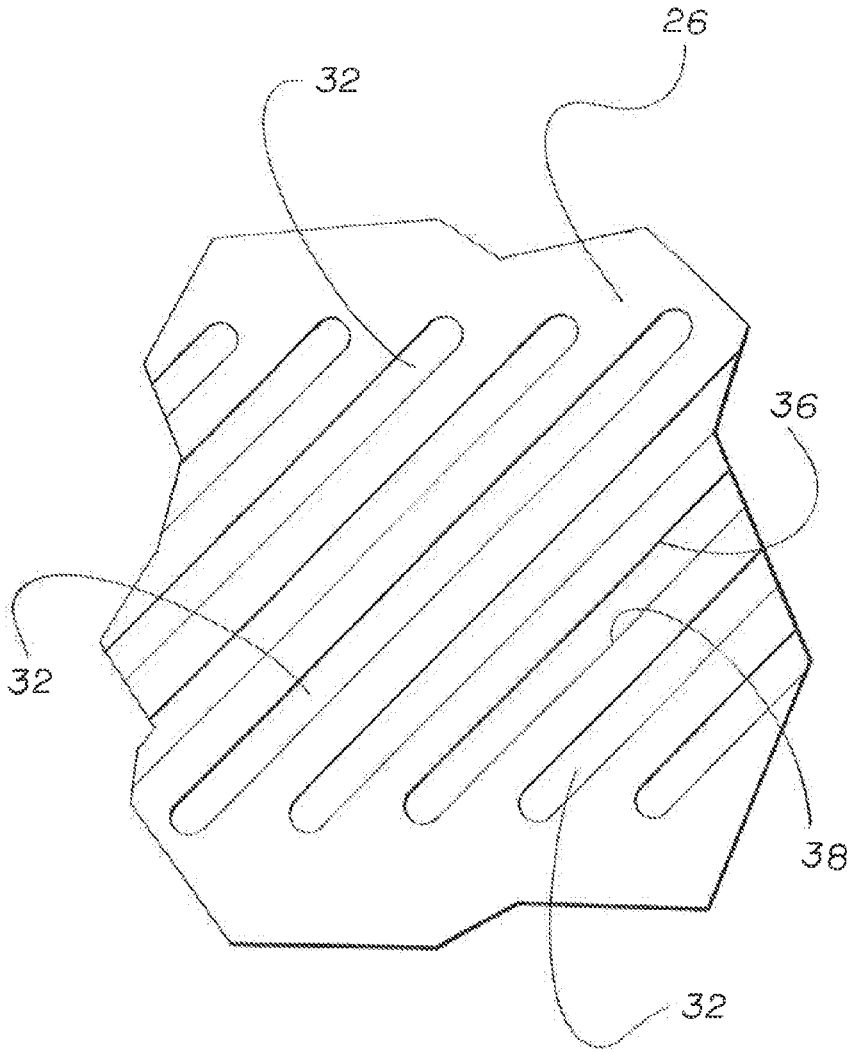
FIG. 3 is a schematic front view of a section of an annular baffle screen plate.

FIG. 3 is a front view of a portion of an exemplary annular screen plate 26 showing openings 32 in the form of diagonal slots. The openings 32 in this exemplary embodiment may be slots that may be sloped such as shown in FIG. 2, or extend horizontally through the annular screen plate 26. The slots may be at regular intervals around the circumference of the annular screen plate 26. The slots may cover a majority of the surface area of the annular screen plate 26. The slots may be arranged vertically, horizontally or at an oblique angle as shown in FIG. 3, or other oblique angle between 0 degrees and 90 degrees, such as 30 degrees and 60 degrees. In other exemplary embodiments, the annular screen plate 26 may be perforated with holes, formed of vertical bars with slots between the bars, or formed of a mesh (holes, vertical bars, and mesh are not shown).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A pressure diffuser washer comprising:

an outer wall;

an inner wall adjacent to the outer wall, the inner wall defining annular baffle chambers between the outer wall and the inner wall, wherein each of the annular baffle chambers is configured to connect to a source of a wash liquid;

a reciprocating screen assembly adjacent to the inner wall, the reciprocating screen assembly defining a first annular chamber between the inner wall and the reciprocating screen assembly;

an area in the inner wall defining a gap associated with each of the annular baffle chambers, wherein the wash liquid from an annular baffle chamber flows through the gap into the first annular chamber; and an annular baffle screen plate covering the gap, wherein the annular baffle screen plate defines openings sized to prevent rocks and other large particulate debris from entering the annular baffle chambers.

2. The pressure diffuser washer as in claim 1, wherein the gap extends around a perimeter of the inner wall, and the annular baffle screen plate extends a perimeter of the gap.

3. The pressure diffuser washer as in claim 1, wherein a screen mesh defines the openings of the annular baffle screen plate.

4. The pressure diffuser washer as in claim 1, wherein an arrangement of parallel bars defines the openings of the annular baffle screen plate.

5. The pressure diffuser washer as in claim 1, wherein the annular baffle screen plate is cylindrical and wherein the inner wall is a cylindrical wall.

6. The pressure diffuser washer as in claim 1, wherein the annular screen plate openings each have an upper corner and a lower corner, wherein the upper corner and the lower corner are curved.

7. A pressure diffuser vessel comprising:

a vertically extending outer cylindrical wall defining an outer portion of a pressurized vessel;

a vertically extending inner cylindrical wall coaxial to the vertically extending outer cylindrical wall, the vertically extending inner cylindrical wall defining annular baffle chambers between the vertically extending outer cylindrical wall and the vertically extending inner cylindrical wall, wherein each of the annular baffle chambers is configured to connect to a source of a wash liquid;

an area in the vertically extending inner cylindrical wall defining a gap associated with each of the annular baffle chambers, wherein the wash liquid from an annular baffle chamber flows through the gap into a first annular chamber; and an annular baffle screen plate covering the gap into the first annular chamber, wherein the annular baffle screen plate defines openings sized to prevent rocks and other large particulate debris from entering the annular baffle chamber.

8. The pressure diffuser vessel as in claim 7, wherein the gap extends around a perimeter of the vertically extending inner cylindrical wall, and the annular baffle screen plate extends the perimeter.

9. The pressure diffuser vessel as in claim 7, wherein a screen mesh and arrangement of parallel bars defines the openings of the annular baffle screen plate.

10. The pressure diffuser vessel as in claim 7, wherein the openings in the annular baffle screen plate each have a length substantially greater than the width of the opening.

11. The pressure diffuser vessel as in claim 7, wherein the annular baffle screen plate has upper edges and lower edges fixed to the vertically extending outer cylindrical wall of the pressure diffuser vessel.

12. The pressure diffuser vessel as in claim 7, wherein a screen assembly moves reciprocally adjacent to the vertically extending inner cylindrical wall of the pressure diffuser vessel, such that the screen assembly defines the first annular chamber between the vertically extending inner cylindrical wall and the screen assembly.

13. The pressure diffuser vessel as in claim 7, wherein the annular baffle screen plate openings each include an upper corner and a lower corner, wherein the upper corner and the lower corner are rounded.

* * * * *